US007422478B2

(12) United States Patent
Zugel et al.

(10) Patent No.: US 7,422,478 B2
(45) Date of Patent: Sep. 9, 2008

(54) ANGLED PLUG-IN CONNECTION COMPRISING A RETAINING ELEMENT THAT DEFINES THE WORKING POSITION OF THE TWO ANGLED LIMBS

(75) Inventors: Fritz Zugel, Waldkirch (DE); Mario Bartholoma, Winden (DE); Volker Gotz, Kenzingen (DE); Philipp Gerber, Gutach (DE)

(73) Assignee: Anton Hummel Verwaltungs GmbH, Waldkirch (DE)

( * ) Notice: Subject to any disclaimer, the term of this patent is extended or adjusted under 35 U.S.C. 154(b) by 0 days.

(21) Appl. No.: 11/573,703

(22) PCT Filed: Jun. 28, 2005

(86) PCT No.: PCT/EP2005/006936

§ 371 (c)(1),
(2), (4) Date: Feb. 14, 2007

(87) PCT Pub. No.: WO2006/018061

PCT Pub. Date: Feb. 23, 2006

(65) Prior Publication Data

US 2007/0249205 A1 Oct. 25, 2007

(30) Foreign Application Priority Data

Aug. 18, 2004 (DE) ..... 20 2004 012 952 U

(51) Int. Cl.
*H01R 9/05* (2006.01)

(52) U.S. Cl. ..... 439/582; 439/578

(58) Field of Classification Search ..... 439/582, 439/578

See application file for complete search history.

(56) References Cited

U.S. PATENT DOCUMENTS

| | | | | |
|---|---|---|---|---|
| 5,176,536 | A * | 1/1993 | Ganger et al. | 439/582 |
| 6,283,510 | B1 * | 9/2001 | Bartholoma et al. | 285/184 |
| 6,300,569 | B1 * | 10/2001 | Mullen, Jr. | 174/655 |
| 6,593,531 | B2 * | 7/2003 | Hulsmann et al. | 174/66 |

FOREIGN PATENT DOCUMENTS

| | | |
|---|---|---|
| DE | 3403772 | 8/1985 |
| DE | 3709963 | 5/1988 |
| DE | 8914027.3 | 2/1990 |
| DE | 20003976 | 6/2000 |

* cited by examiner

*Primary Examiner*—Truc T. Nguyen
*Assistant Examiner*—Xuong Chung-Trans
(74) *Attorney, Agent, or Firm*—Volpe and Koenig, P.C.

(57) ABSTRACT

An electric angled plug-in connector (1) is provided having an insulating body that is arranged in a first angled limb (2) and that contains electric contacts. One or more electric wires extend through a second angled limb (3). The two opposing faces (2*a*, 3*a*) of the angled limbs (2, 3) that lie in the angled area are diagonal, essentially forming a miter and are connected to each other in an articulated or detachable manner. At least one of the angled limbs is provided with a retaining element (11) having a cavity in the form of a recess, opening (10), or undercut. The continuation of the cavity of the retaining element (11) on the other angled limb located in the closed position is provided with a seat or guide (12) that extends around an exterior of the angled limb and a coupling element (13) is mounted in the receiving element or guide (12) and in the cavity in order to fix the two angled limbs (2, 3) to one another, thus blocking a relative motion or pivoting of the angled limbs (2, 3) relative to one another.

13 Claims, 2 Drawing Sheets

ANGLED PLUG-IN CONNECTION COMPRISING A RETAINING ELEMENT THAT DEFINES THE WORKING POSITION OF THE TWO ANGLED LIMBS

BACKGROUND

The invention relates to an electric angled plug-in connector, in particular having an insulating body provided with electric contacts, which is arranged in the working position in a first angled limb of said plug-in connector, with one or more of the electric wires also extending through a second angled limb to a load or to a power source, and the two adjacent faces of the angled limbs are arranged laterally and essentially mitered in the angled area and, in particular in the area of an exterior median line, are connected to each other at least in the working position preferably in an articulate or detachable manner, and additionally include a retaining element to fix the two angled limbs in the working position.

An angular plug-in connector of this type is known and proven from DE 200 03 976.8 U1. For the mutual fixation of the two angled limbs in their working position flanges or flange pieces are provided at these two angled limbs, both of which can be mounted to each other and to a housing wall or a complementary part by a common penetrating screw. This results in a fixation of the two angled limbs in reference to each other in their working position, however, this fixation is relatively tedious when the two angled limbs are closed. It must primarily be considered time consuming that the screwing process must sometimes be performed several times, primarily when several screws are used.

Additionally, an angled wiring guide, i.e. an angled plug-in connector, is known from DE 34 03 772 C2 and DE 37 09 963 C1, however without any insulating body with electric connectors, in which the two angled limbs can be snapped to each other in their working position. The snapping device is here mounted to the angled limbs themselves. The mutual connection is therefore no longer possible when, for example, one of the snapping protrusions is damaged or breaks off due to material fatigue and excessive stress.

SUMMARY

Therefore, the object is to provide an electric angled plug-in connector of the type defined at the outset, in which the assembly and particularly the process of reaching the working position as well as its fixation requires less time and reduces the risk of the mutual connection of the angled limbs becoming defective.

In order to attain this object, the plug-in connector defined at the outset is improved in that at least one retaining element, comprising at least one cavity, namely a depression, opening, or undercut is provided on one angled limb, and in a continuation of the retaining element cavity, at the other angled limb in the closed position, a seat or guide extends from its exterior and in order to fix the working position of the two angled limbs to each other at the seat or guide and in the cavity, a common coupling element can be mounted or can be moved into or can be pushed into or be inserted therein, blocking the relative motion or pivoting of the angled limbs.

Therefore, snapping elements or snapping protrusions connected to the angled limbs in one piece are avoided, as well as the need for flanges for inserting and mounting screws. The angled limbs only need to be brought into their working position, i.e. the position, at which the two facing surfaces are at their closest proximity or contact each other, in order to allow the insertion of the coupling element into the corresponding seats, guides, or cavities, which can be done quickly and easily.

Here, the seat or guide can be a recess, groove, or channel at least in parts radially open towards the exterior. Here, a complementarily shaped coupling element can be held rather well even against lateral displacements, although the seat may also be simply the exterior of the respective angled limb, if necessary, which then practically forms only one seat, its position being predetermined by the retaining element of the other angled limb. However, it is advantageous for a rapid assembly when this seat or guide is of greater depth and respectively already guides the coupling element during the insertion and primarily fixes it in a form-fitting manner in the working position perpendicular to the plane defined thereby.

The retaining element arranged at one angled limb may protrude from its exterior contour. This way, it has a sufficiently large cross-section in order to provide a recess into which the coupling elements can easily be inserted when it is engaged by the other angled limb.

A particularly good connection results when two retaining elements are provided on one angled limb across the longitudinal center from and facing each other or mounted mirror symmetrically, and when the seat or guide extending from the other angled limb over a part of its circumference continues into the recesses of the two retaining elements, and when the coupling element has two limbs which fit into the retaining element and its recesses. Thus, the coupling element can encircle one angled limb in the area of the seat or guide and can be inserted into two retaining elements at the other angled limbs with the legs protruding therefrom and thus determine the working position of the two angled legs. Here, the assembly is very simple because the coupling element can practically be inserted with its two legs into the retaining elements such that the connection of these legs in the working position contacts the seat or guide and thus prevents a folding open of the two angled limbs.

Here, it is particularly advantageous for the coupling element to be embodied approximately U-shaped and for the free ends of the U-limbs to be insertable into or to engage the recess of the retaining elements, and when the U-cross, forming a stabilizer or abutment, can fit into and/or engage the seat or guide arranged at the other angled limb in the working position, in particular a recess or groove forming it. Such a U-shaped coupling element can therefore be easily inserted into the angled limb provided with a seat or guide, with its U-limbs then being moved along said angled limb and finally protruding therefrom. This protruding or extending portion can engage the recess of the respective depression and retaining element provided as an extension of the seat or guide, and thus affect the mutual fixation of the two angled limbs.

Based on its straight progression, the U-shaped limbs of the coupling element prevent, in the working position, the two angled limbs from being pivoted in reference to each other because they would need to perform an arc-shaped motion, which is blocked by the straight U-limbs.

An even better mutual connection and an improved form-fitting can be achieved when the retaining element or elements has/have an opening as the recess, which has a closed cross-section and extends in the longitudinal direction of the U-limbs of the coupling element, having in its/their interior and/or at its/their end a widened section or mouth forming an undercut, and when the U-limb engaging the opening of the retaining element having a deformation at its area located in the widened part or behind the mouth of the opening, in particular a protrusion, snapping in the working position into the widened part or the undercut or behind the mouth of the opening.

In this manner, the coupling element can be snapped into its locking position so that it is held even better and is secured from unintentional loosening. Here, the protrusions on the U-limbs can be aligned in the opposite direction of motion in reference to each other so that, for example, they protrude from the U-limbs when seated behind the mouths of the recesses and can be brought back into a loosened position by a knowledgeable user compressing the two U-limbs.

The seat or guide can be arranged at least in the area of the first angled limb near the retaining element of the other angled limb, which first angled limb being partially encircled by the coupling element in the working position, and the seat or guide can have a closed cross-section, in particular, which is equivalent to the recess or opening of the retaining element of the other angled limb at least in parts. In the continuation of the closed area of the seat or guide a groove, open towards the outside, may extend toward the other side of the angled limb and to the second area having a closed opening or groove.

In such a combination of features the, in particular U-shaped, coupling element can first be inserted through the closed opening of the first angled limb, through which it reaches and continues to the seat or openings of the retaining elements of the second angled limb, and then, in particular after snapping the two angled limbs in their working position, are connected to each other and fixed in this working position.

Here, it is useful when the retaining element provided with a recess, protrudes from the angled limb carrying it in reference to an exterior contour of said limb. This allows sufficient space for the accommodation of a recess without reducing the wall thickness of the angled limb or forcing the interruption of the wall of the angled limb in the area of the retaining element, which also would be possible.

A modified embodiment of the plug-in connector according to the invention may provided in that the retaining element or elements is/are provided with a recessed groove open towards the outside at one angled limb forming the recess, having a recess or a declining stop at its end section or end opposing the other angled limb, with this recessed groove extending coaxially to the longitudinal central axis or approximately in the longitudinal central level of the angled limb carrying it, and that, an at least partially curved or arc-shaped groove is provided at the other angled limb as a seat or guide, its contour following the cross-section of the angled limb, which continues into the recessed groove of the two angled limbs in the working position and that the coupling element at its end and/or at the end of the U-shaped limbs is provided with snapping catches or widened sections or protrusions facing inwardly or each other, which fit in the working position into the seat or behind the stop of the recessed groove.

While in the above-described arrangements the retaining element and its recess extend perpendicular to a longitudinal plane of the angled limb supporting said retaining elements, the retaining element may also be arranged approximately along said longitudinal central axis, i.e. in particular the U-shape coupling element may be off-set in various exemplary embodiments by 90° in reference to each other, when in turn the two angled limbs form an angle of 90° in reference to each other, in the most frequent embodiment, in their working position.

The mirror-symmetrically recessed grooves, provided at their ends with recesses or stops and arranged on one angled limb and the arc-shaped extending groove of the other angled limb can each be provided at cross-sectional thickenings or protrusions of the angled limbs. In this manner, these grooves and recesses may have a sufficiently great depth in order to offer space for a coupling element embodied respectively thick, which can be lowered into it or be flush with it at its edges in order not to protrude in the working position.

The arc-shaped extending grove can extend over half the circumference of one angled limb having, in particular, an approximately circular cross-section, and continue in a guide or a recess and/or a recessed groove of the other angled limb.

However, it is also possible for the cross-section of the angled limb to be embodied circular, semi-circular, and/or multi-faceted, in particular rectangular or square, and to be provided at both angled limbs with similar, in particular with identical dimensions, or different ones. Depending on the cross-section of the angled limbs the coupling element is then appropriately formed in the area between the two U-shaped limbs in order to encircle and cover the angled limb with this section and preferably to contact is over its surface.

The distance between the U-shaped limbs of the coupling element is usefully equivalent to approximately the cross-sectional dimensions or the diameter of the angled limbs with the seat or the guide at the location where the interior side of the coupling element contacts in the working position. The U-shaped limbs of this coupling element then extend parallel to each other and are approximately tangential from the location of the largest cross-sectional dimension of this angled limb until they reach the retaining element of the other angled limb in its working position and beneficially snaps into engagement there.

Primarily in combinations of individual or several of the above-described features and measures, an angled plug-in connector results in which the two angled limbs in their working position are fixed by a plug-in and preferably also a snapping coupling element, which operates every easily and quickly, and which also allows detachment, without any tedious screwing processes having to be performed. Here, the risk is also very low that damages can lead to the situation, in which the mutual connection of the angled limbs is no longer possible. Not only the assembly costs but also the production costs are appropriately reduced due to the fact that such essentially U-shaped coupling elements can be produced very cost effectively from metal or plastic.

BRIEF DESCRIPTION OF THE DRAWINGS

In the following, exemplary embodiments of the invention are explained in greater detail using the drawing. Shown in a partially schematic representation are.

DETAILED DESCRIPTION OF THE PREFERRED EMBODIMENTS

Figure 2:
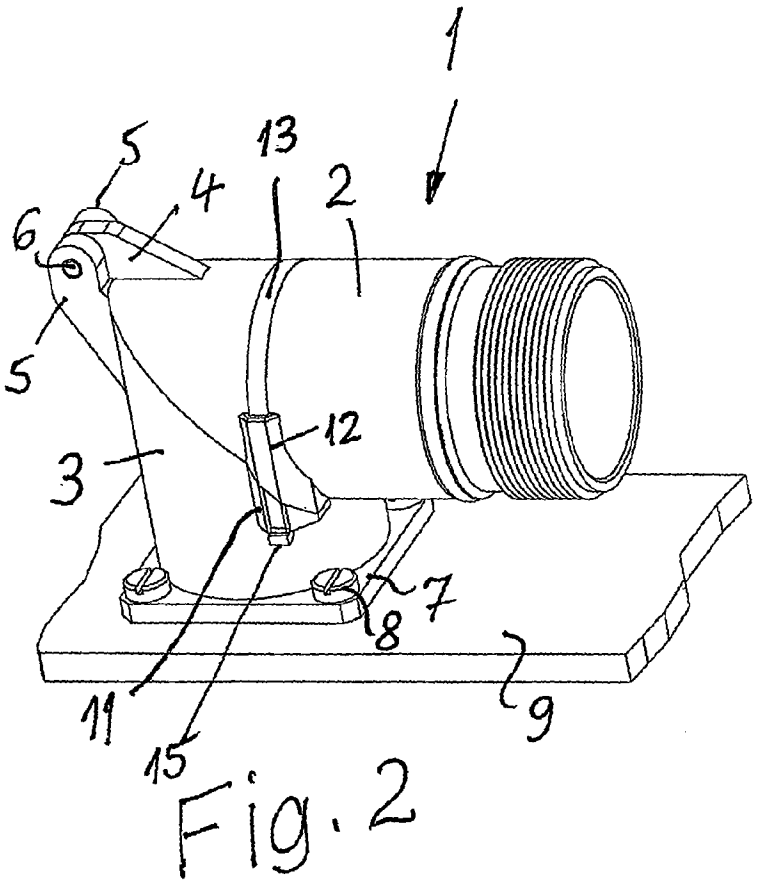
FIG. 2 is a view according to FIG. 1 after the pivoting of the upper angled limb into its working position, in which the two faces, facing each other and being mitered, are at the closest proximity of the two angled limbs in reference to each other and/or contact each other, with the coupling element in its working position blocking any pivoting of the angled limbs into the opened position.

Parts which are identical in their function in the description of the two exemplary embodiments are provided with identical reference characters even when their shape is modified.

An electric, angular plug-in connector, in its entirety indicated as 1, may comprise in a first angled limb 2, in a manner not shown in greater detail, an insulating body with electric contacts, from which one or more wires may also extend through a second angled limb 3 to a consumer or to a power source. The two faces 2*a* and 3*a* of the angled limbs 2 and 3 that contact at an angle are formed and arranged in both exemplary embodiments diagonally and essentially mitered, and are connected in an articulated or detachable manner in the area of the exterior meridian line, with a flange part 4 on the angled limb 2 and two flange parts 5 extending parallel and provided on the angled limb 3 that are provided at a distance from each other surrounding the flange part 4 on both sides, and with an articulate pin 6 connecting the flange parts in a pivotal manner.

Additionally, a retaining element is provided, fixing the working position of the two angled limbs 2 and 3 in a manner to be described.

The angled limb 3 is here mounted to a housing wall 9 or another counterpart via a flange 7 and screws 8.

On one of the angled limbs, at least one retaining element 11 is provided with a recess, in the exemplary embodiment an opening 10 or a perforation or a recess or an undercut, and in continuation of this retaining element 11 and its recess or opening 10, a seat or guide 12 is provided on the other angled limb extending over its exterior circumference. In order to fix the two angled limbs 2 and 3 to each other in the working position, a coupling element 13 is provided, which on the one side engages the seat or guide 12 and on the other side can be moved into or pushed into or inserted into the recess 16 or opening 10, i.e. can be mounted to the retaining element 11 and in this retaining position blocks the relative motion or pivoting of the angled limbs 2 and 3 in this fixed position according to FIG. 2 or 4.

Figure 1:
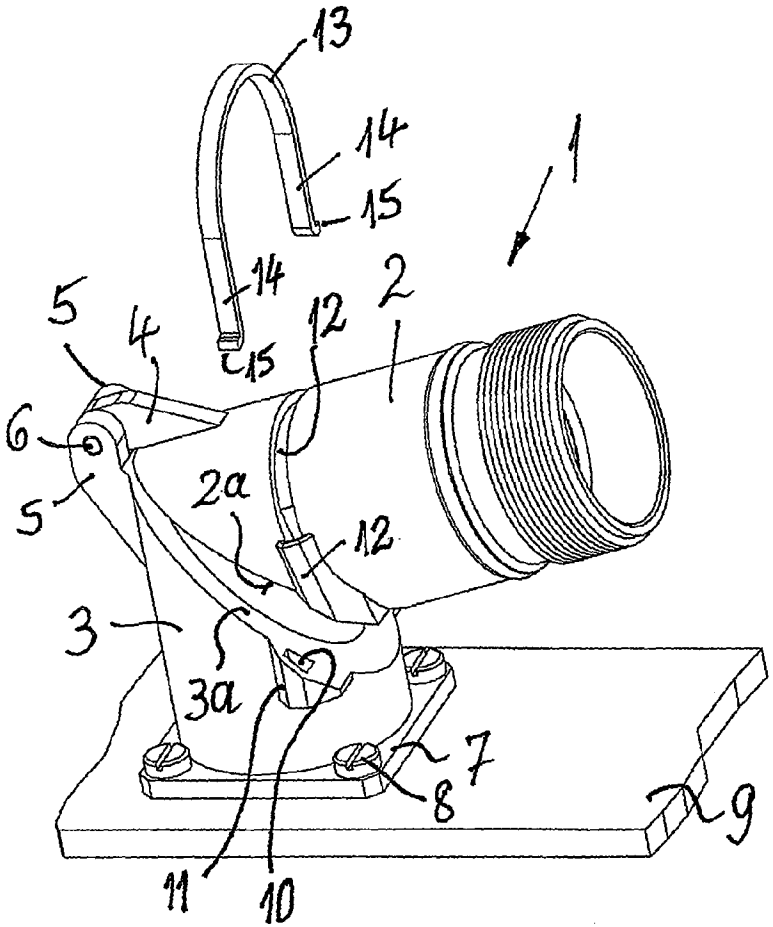
FIG. 1 is a view of a plug-in connector according to the invention with two angled limbs, pivotable in reference to each other, one of which is screwed to a separating housing wall via a flange and the other one being provided with a seat or guide for a coupling element not yet connected in its seat or guide, which additionally fits into the retaining elements arranged at the first mentioned angled limb.
Figure 3:
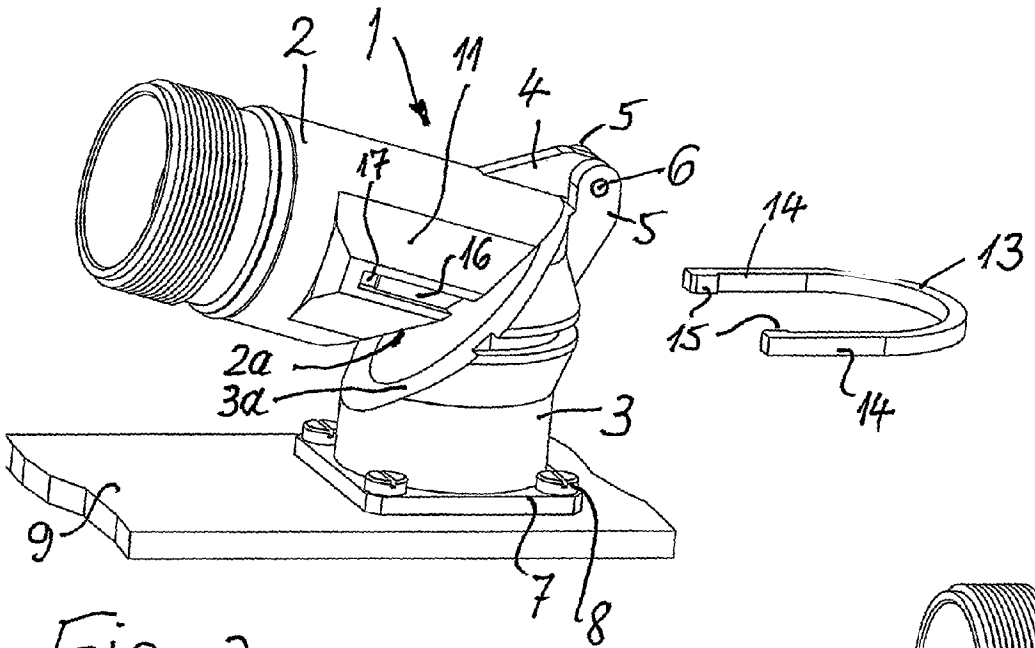
FIG. 3 is a view similar to FIG. 1, with the coupling element and the recesses and retaining elements provided for it being arranged pivotable in reference to FIGS. 1 and 2 by 90°, with the angled limbs not having reached their closed position.
Figure 4:
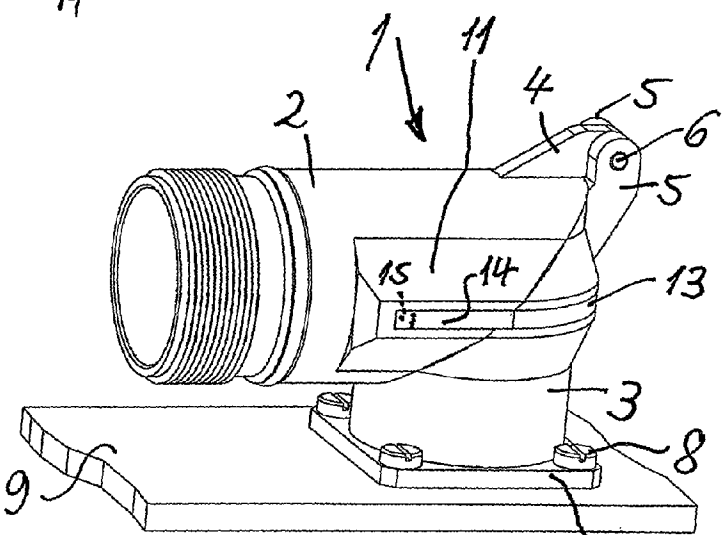
FIG. 4 is a view according to FIG. 3, in which the two angled limbs are in their closed position and fixed by a coupling element.

Here, the seat or guide 12, in the exemplary embodiment according to FIGS. 1 and 2, is located on the angled limb 2 and the retaining element 11 with the opening 10 is arranged on the angled limb 3, while in the exemplary embodiment according to FIGS. 3 and 4 the seat or guide 12 is arranged on the angled limb 3, and therefore the retaining element 11 cooperating therewith is supported by the angled limb 2.

In both exemplary embodiments the seat or guide 12 is a recess, groove, or channel, which in some parts is radially open towards the outside, as is particularly well discernible in FIGS. 1 and 3.

In this groove, the coupling element 13 can be inserted in a manner to be described with simultaneously parts of the coupling element 13 then entering the area of the retaining element 11 and thus blocking the relative motion of the angled limb 2.

Here, it is further discernible in both exemplary embodiments that the retaining element 11 arranged on one angled limb protrudes from its exterior contour in order to allow sufficient space for an opening 10 or a recessed groove 16 with a sufficient radial depth.

In both exemplary embodiments it is also provided that on one angled limb, in reference to its longitudinal center, there are two opposing, mirror-symmetrically arranged and embodied retaining elements 11, and that the seat or guide 12, extending on the other angled limb over a part of its circumference, continues in the recess or opening of both retaining elements 11. The coupling element 13 has two legs 14 in both exemplary embodiments, which fit into the retaining element 11 and its recesses 16 or openings 10, i.e. the coupling element is embodied approximately U-shaped. The free ends of the U-limbs 14 are therefore insertable or can be pushed into the recesses or openings 10 of the retaining elements 11 and engage them in the working position. In the working position the U-cross bar of the overall U-shaped coupling element 13 fits as a stabilizer or abutment into the seat or guide 12 arranged on the other angled limb and engages the recesses or grooves forming the seat or guide 12 and/or said guide groove 12 in the working position according to FIGS. 2 and 4.

In the exemplary embodiment according to FIGS. 1 and 2, the retaining elements 11 have as recesses one opening 10 each, provided with a closed cross-section and extending in the plug-in direction of the U-limb 14 of the coupling element 13, which opening has at its interior or, as discernible in FIG. 2, at its end an undercut formed by a widening or a mouth. In the working position, the U-limbs 14 engage the opening 10 of the retaining elements 11 through a deformation in the area located behind the mouth of the opening 10, namely a protrusion 15, which snaps in the working position behind the mouth of the opening 10, as shown in FIG. 2. With this protrusion 15, the U-limbs 14 can be pushed back, against their positioning force, and thus they can be pushed out of the opening 10 and the retaining element 11, when the angled limb 2 is to be opened in reference to the angled limb 3. The protrusions 15 of the two U-limbs 14 here face outward away from each other and are located in a plane defined by the coupling element 13.

The recess or guide 12 is here arranged in the area of the angled limb 2 in proximity to the retaining elements 11 of the angled limb 3, which is partially encircled by the coupling element 13 in the working position. Here, this seat or guide 12 in the proximity of the retaining element 11, also has a closed cross-section, which is approximately equivalent to the opening 10 at the retaining element 11. The continuation of the closed area of the seat or guide 12 then extends as a part of the guide 12 as a groove, open towards the outside, to the other side of the angled limb 2 and to the second area with a closed opening, i.e. in the arrangement discernible from FIGS. 1 and 2 it is also similarly provided on the opposite side of the angled limb 2 in a mirror-symmetrical manner. In this manner, the U-limbs 14 of the coupling element 13 are already guided at the angled limb 2 on all sides and are totally enclosed by both angled limbs 2 and 3.

Both in the exemplary embodiment according to FIGS. 1 and 2 as well as in the exemplary embodiment according to FIGS. 3 and 4, the retaining elements 11 protrude in reference to the exterior contour or surface of the respectively supporting angled limb 3 or 2, as clearly discernible form the drawings.

In the exemplary embodiment according to FIGS. 3 and 4, the retaining elements 11 are provided at the angled limb 2 as recesses each with a recessed groove 16 open towards the outside, however in this case the opening 10 could also be closed in its cross-section, similar to FIG. 1 or 2, as in turn in the exemplary embodiment according to FIGS. 1 and 2, instead of a closed opening 10, a recessed groove 16 could be provided at the retaining element 11.

The recessed groove 16 has at its end region, opposite the other angled limb 3 or the end, a recess 17, which may also be embodied as a declining stop, with this recessed groove 16 extending coaxially to the longitudinal central axis and approximately in the longitudinal central plane of the angled limb 2 provided. At the other angled limb 3, a sectionally curved or, according to the cross-sectional contour of this angled limb 3, arched groove is provided as the seat or guide 12 in this case, following the contour of the cross-section of this angled limb 3, which continues in the operational position of the two angled limbs 2 and 3 according to FIG. 4 in the recessed groove 16. In this case, the coupling element 13 has at the end of its U-limbs 14 facing inwardly and each other residual catches or widening 15, which in the working position fit into the recess 17 or behind a stop at the end of the recessed groove 16, and snap here, which in turn creates a form-fitting yet still detachable connection.

Here, it is discernible in FIGS. 3 and 4 that the recessed grooves 16, mirror-symmetrically provided at one angled limb 2, is provided at its end with recesses 17 or stops, and the arc-shaped guide groove 12 extending from the other angled limb 3 is provided with thickenings of the cross-section or protrusions of the angled limbs. In this exemplary embodiment the respective cross-sectional thickenings of the angled limb 2 are here the retaining elements 11.

In both exemplary embodiments, the guiding groove 12 is arranged over half of a circumference, with it having a circular or semi-circular cross-section in both exemplary embodiments in an arc shape and extending at the respective angled limb. It then continues in a guide or a recess or a recessed groove of the other angled limb.

It must be mentioned that the cross-section of the angled limbs 2 and 3, as in both exemplary embodiments, may be circular or semi-circular or, deviating therefrom, also multifaceted, in particular rectangular or square, and at both angled limbs may be provided in particular with identical dimensions, or also with different ones. For example, one of the angled limbs may have a circular and the other one a square cross-section. However, both angled limbs may also be square or rectangular. Additional combinations are possible.

The distance of the U-limbs 14 of the coupling element 13 is here equivalent in all cases approximately to the cross-sectional dimension or the diameter of the angled limb with the seat or the guide 12 at the place that contacts the interior of the coupling element 13 in the working position. The U-limbs 14 of the coupling element 13 therefore extend from the arc-shaped area approximately tangential into straight extensions, as particularly well discernible in FIGS. 1 and 3. Also, they may extend from the angled limb provided with a seat or guide 12 tangentially further to the other angled limb and here mounted together with retaining elements 11 in the working position of the two angled limb.

The angled plug-in connector 1 is provided with an insulating body comprising electric contacts, which is arranged in a first angled limb 2, with one or more electric wires extending through a second angled limb 3, and the two faces 2*a*, 3*a*, of the angled limbs 2, 3, which contact one another in the angled area, are arranged diagonally and essentially mitered and connected to each other in an articulated and detachable manner. At one of the angled limbs, at least one recess is provided, namely a recess, opening 10, or a retaining element 11 having an undercut and in a closed position a recess or guide 12 of the other angled limb continues the recess of the retaining element 11, and the seat or guide 12 is arranged extending on the outside and for fixing the two angled limbs 2, 3 in reference to each other, and, in the recess, a common coupling element 13 is provided, which blocks the relative motion or pivoting of the angled limbs 2, 3 relative to one another.

The invention claimed is:

1. An electric angled plug-in connector comprising an insulating body provided with electric contacts, which in a working position is arranged in a first angled limb of the plug-in connector, with one or more electric wires extending to a consumer or a power source through a second angled limb, and two faces of the angled limbs adjacent in an angled area are arranged diagonal and essentially mitered in an area of an exterior median line and are connected to each other at least in a working position in an articulated or detachable manner, for fixing the working position of the two angled limbs, at least one cavity is provided on the first angled limb comprising a retaining element with a recess, and at the second angled limb a seat or guide is provided that is a continuation of the cavity of the retaining element in a closed position, and a common coupling element extends around an exterior of the second angled limb and in order to fix the working position of the two angled limbs to each other at the seat or guide, the common coupling element is mounted, moved into, pushed into, or inserted in the recess, blocking a relative motion or pivoting of the angled limbs relative to one another, the retaining element with the recess on the first angled limb comprises a recessed groove that opens toward the outside, which at an end region, opposite to the other angled limb is unprovided with a recess or has a declining stop, the recessed groove extends coaxially in reference to a longitudinal central axis or approximately in a longitudinal central plane of the angled limb, and at the second angled limb the seat or guide comprises an at least partially curved or arc-shaped groove that follows a contour of the cross-section of the angled limb, which continues the recessed groove in the working position of the two angled limbs, and the coupling element at ends thereof includes stop catches or widened sections facing inward, which in the working position fit into the recess or behind the recess of the recessed groove, and on the first angled limb the retaining element comprises two opposing, mirror-symmetrically arranged retaining elements that are symmetric in reference to a longitudinal center, and the seat or guide extending from the other angled limb over a part of a circumference thereof continues to the recesses of the two retaining elements, and the coupling element has two limbs fitting into the retaining elements and the recesses thereof.

2. A plug-in connector according to claim 1, wherein the seat or guide is a recess, groove, or channel at least partially radially open toward an exterior of the second angled limb.

3. A plug-in connector according to claim 1, wherein the retaining element arranged at the first angled limb protrudes in reference to an exterior contour thereof.

4. A plug-in connector according to claim 1, wherein the seat or guide is arranged at least in an area of the first angled limb near the retaining element of the second angled limb, which is partially encircled by the coupling element and the recess or guide has a closed cross-section, which is equivalent to the opening of the retaining element of the other angled limb, at least partially.

5. A plug-in connector according to claim 1, wherein in a continuation of the closed area of the recess or guide, a groove that is open towards outside, extends to an other side of the angled limb and to a second area with a closed opening or groove.

6. A plug-in connector according to claim 1, wherein the retaining elements provided with recesses protrude in reference to an exterior contour of the angled limb to which they are attached.

7. A plug-in connector according to claim 1, wherein the recessed groove comprises grooves that are mirror-symmetrically provided on the second angled limb and are provided at ends thereof with recesses or stops, and the arc-shaped grooves extending on the second angled limb are each provided at cross-sectional thickenings or protrusions of the angled limb.

8. A plug-in connector according to claim 1, wherein the groove extending arc-shaped on the second angled limb over half of a circumference thereof, has a circular cross-section and extends over the angled limb and continues into the recessed groove of the first angled limb.

9. A plug-in connector according to claim 1, wherein a cross-section of the angled limb is at least one of circular, semi-circular, or multi-faceted, and both of the angled limbs are approximately identical.

10. A plug-in connector according to claim 1, wherein the coupling element is approximately U-shaped with U-limbs, and free ends of the U-limbs can be inserted into or engage the recesses of the retaining elements, and a U-cross bar acts as a stabilizer or abutment in the working position and at least one of fits into or engages the seat or guide arranged at the other angled limb.

11. A plug-in connector according to claim 10, wherein the retaining elements have openings provided with a closed cross-section and extending as the recess in an insertion direction of the U-limbs of the coupling element, which in at least one of an interior or at ends thereof have a widening or mouth forming an undercut, and the U-limbs engage in the openings of the retaining elements at an area located in the widened section or behind the mouth of the opening, and include a deformation comprising a protrusion, which in an operational position snaps into the widened section, undercut, or behind the mouth of the opening.

12. A plug-in connector according to claim 10, wherein a distance between the U-limbs of the coupling element is approximately equivalent to a cross-sectional dimension or a diameter of the second angled limb with the seat or the guide at a location where interior sides of the coupling elements contact in the working position.

13. A plug-in connection according to claim 10, wherein the protrusions provided at the U-limbs face away from each other.

* * * * *